US005585898A

United States Patent [19]

Fujii

[11] Patent Number: 5,585,898

[45] Date of Patent: Dec. 17, 1996

[54] DEVELOPING UNIT DRIVING MECHANISM IN USE WITH A COLOR IMAGE FORMING APPARATUS

[75] Inventor: Yozo Fujii, Hachioji, Japan

[73] Assignee: Konica Corporation, Tokyo, Japan

[21] Appl. No.: 398,180

[22] Filed: Mar. 2, 1995

[30] Foreign Application Priority Data

Mar. 9, 1994 [JP] Japan ..... 6-038630

[51] Int. Cl.[6] ..... G03G 15/06

[52] U.S. Cl. ..... 355/245; 355/327

[58] Field of Search ..... 355/245, 326 R, 355/327, 200; 475/12, 5, 204, 205

[56] References Cited

U.S. PATENT DOCUMENTS

| | | | |
|---|---|---|---|
| 3,987,756 | 10/1976 | Katayama et al. | 355/327 X |
| 5,168,319 | 12/1992 | Kimura et al. | 355/326 |
| 5,365,301 | 11/1994 | Sugita et al. | 475/12 X |
| 5,440,377 | 8/1995 | Izawa et al. | 355/245 |

FOREIGN PATENT DOCUMENTS 61-212866 9/1986 Japan .

*Primary Examiner*—Robert Beatty
*Attorney, Agent, or Firm*—Finnegan, Henderson, Farabow, Garrett & Dunner, L.L.P.

[57] ABSTRACT

A developing unit driving mechanism in use with a color image forming apparatus. The mechanism includes: a photoreceptor drum for holding plural color toner images which are developed from a latent image; plural developing units, disposed around the photoreceptor, each for developing the latent image; a driving motor, rotatable in the normal direction and the reverse direction, for driving the plural developing units; a planetary gear mechanism, including a sun gear and a planetary gear, for transmitting a driving force of the driving motor from the driving motor to a set of driven gears; and the set of driven gears, each for transmitting the driving force of the driving motor from the planetary gear mechanism to one of the plural developing units. In such a mechanism, the planetary gear is revolved on the sun gear in one direction so as to be connected with one of the set of driven gears when the driving motor rotates in the normal direction; and the planetary gear is revolved in the opposite direction, so as to be connected with other one of the set of driven gears when the driving motor rotates in the reverse direction. The planetary gear rotates on its axis for transmitting the driving force to a connected one of the driven gears.

8 Claims, 16 Drawing Sheets

DEVELOPING UNIT DRIVING MECHANISM IN USE WITH A COLOR IMAGE FORMING APPARATUS

BACKGROUND OF THE INVENTION

The present invention relates to a developing unit driving means for a color image forming apparatus in which a plurality of developing units are disposed around an image forming member, and a color toner image is formed when a plurality of monochrome toner images are superimposed on each other.

Conventionally, as disclosed in Japanese Patent Publication Open to Public Inspection Nos. 257143/1987 and 226266/1990, the color image forming apparatus is structured as follows. A developing unit holder including a plurality of developing units is provided around an image forming member having a small diameter; the developing unit holder is rotated or slid so that a required developing unit can be selected when it is moved to a position opposed to the image forming member; a developing unit driving gear driven by a developing unit driving motor is previously disposed at a position opposed to the image forming member; and when the developing unit is moved to that position, the developing unit is automatically engaged with the gear.

However, in the development system in which the developing unit is integrally rotated with the developing unit holder as described above, the following disadvantages are encountered:

① Because the developing unit itself, in which developer is accommodated, is rotated, the developer spills from the developing unit. In order to prevent the developer from spilling, it is necessary to provide a more complicated mechanism.

② Because the developing unit is always moved, it is necessary to provide a special mechanism by which the developing unit and the image forming member are very accurately positioned to each other every time when the developing unit is moved.

③ Dimensions of a rotation mechanism, by which a plurality of developing units are integrally rotated, are increased, and therefore, dimensions of the apparatus are also increased.

On the other hand, there is provided a method in which a plurality of developing units are provided around the image forming member as disclosed in Japanese Patent Publication Open to Public Inspection No. 87770/1991, and a developing unit drive system of this development system is structured as follows. A drive transmission path from the developing unit driving motor, which is a driving source, to each developing unit is composed of a driving belt and a gear train. A plurality of electromagnetic clutches are disposed along the drive transmission path corresponding to each developing unit. When a required developing unit is rotated, the corresponding electromagnetic clutch is connected to the developing unit.

However, in this method, the following disadvantages are encountered:

① It is necessary to provide a plurality of electromagnetic clutches corresponding to the number of developing units, resulting in a higher cost and a larger space.

② In these clutches, in which clutch members are engaged with each other by the frictional force, because clutch members are worn out with the lapse of time, so that slippage occurs, the rotational speed of the developing sleeve is lowered. Accordingly, the development density is directly affected, and there is a possibility that the density is lowered.

The present invention has solved the foregoing problems, and the object of the present invention is to provide an inexpensive developing unit driving means, which can be installed into a smaller space, and is highly reliable.

SUMMARY OF THE INVENTION

The present invention has solved and improved the foregoing problems. As a result, an objective of the present invention is to provide an inexpensive developing unit driving means, which can be installed into a smaller space, for a color image forming apparatus.

The above objective can be attained by a developing unit driving mechanism for a color image forming apparatus, characterized by the following structures. The developing unit driving mechanism has a plurality of developing units disposed around the image forming member, a reversible developing unit driving motor, a planetary gear mechanism for transmitting the driving force of the developing unit driving motor to the developing unit, and a pair of driven gears for transmitting rotation to each of the two developing units. A planetary gear of the planetary gear mechanism is arranged so as to be revolved on a sun gear to a position, at which it is engaged with one of the pair of driven gears, when the developing unit driving motor is rotated normally or reversed. After the planetary gear has been engaged with the driven gear, the motive power of the developing unit driving motor is transmitted to the driven gear when the planetary gear is rotated.

Further, in the present invention, a preferable embodiment of the developing unit driving mechanism for the color image forming apparatus is characterized in that: at least one of the pair of driven gears is an idler gear by which the rotational direction is changed; and the driving unit driving mechanism has 2 planetary gear mechanisms, a planetary gear selector for selecting one of the 2 planetary gear mechanisms, and a developing unit drive control section. The planetary gear selector is a switching means by which the revolution of one planetary gear of the planetary gear mechanisms is prevented and the revolution of the other planetary gear is allowed. The developing unit drive control section selects the rotational direction of the developing unit driving motor and the switching position of the planetary gear selector, when the developing unit to be driven is selected.

Further, the above-described objective can be attained by the developing unit drive mechanism structured as follows. In a color image forming apparatus in which a plurality of developing units are disposed around the image forming member, and a color image is obtained when the developing units are successively switched and driven, the developing units are successively driven by mechanical clutches, and these mechanical clutches are switched when the rotational speed of the developing unit driving motor is decreased, or while the developing unit driving motor is being accelerated after the developing unit driving motor has been stopped and started again. Further, the above-described objective can be attained by the developing unit drive mechanism structured as follows. In a color image forming apparatus in which a plurality of developing units are disposed around the image forming member, and a color image is obtained when the developing units are successively switched and driven, the developing units are successively driven by mechanical clutches, and the developing units are driven sequentially from the developing unit positioned on the upstream side of the rotational direction of the image forming member.

DETAILED DESCRIPTION OF THE INVENTION

Before explanation of an example of the present invention, the structure and operations of an image forming apparatus of the present invention will be explained referring to FIG. 1 through FIG. 4.

Figure 1:
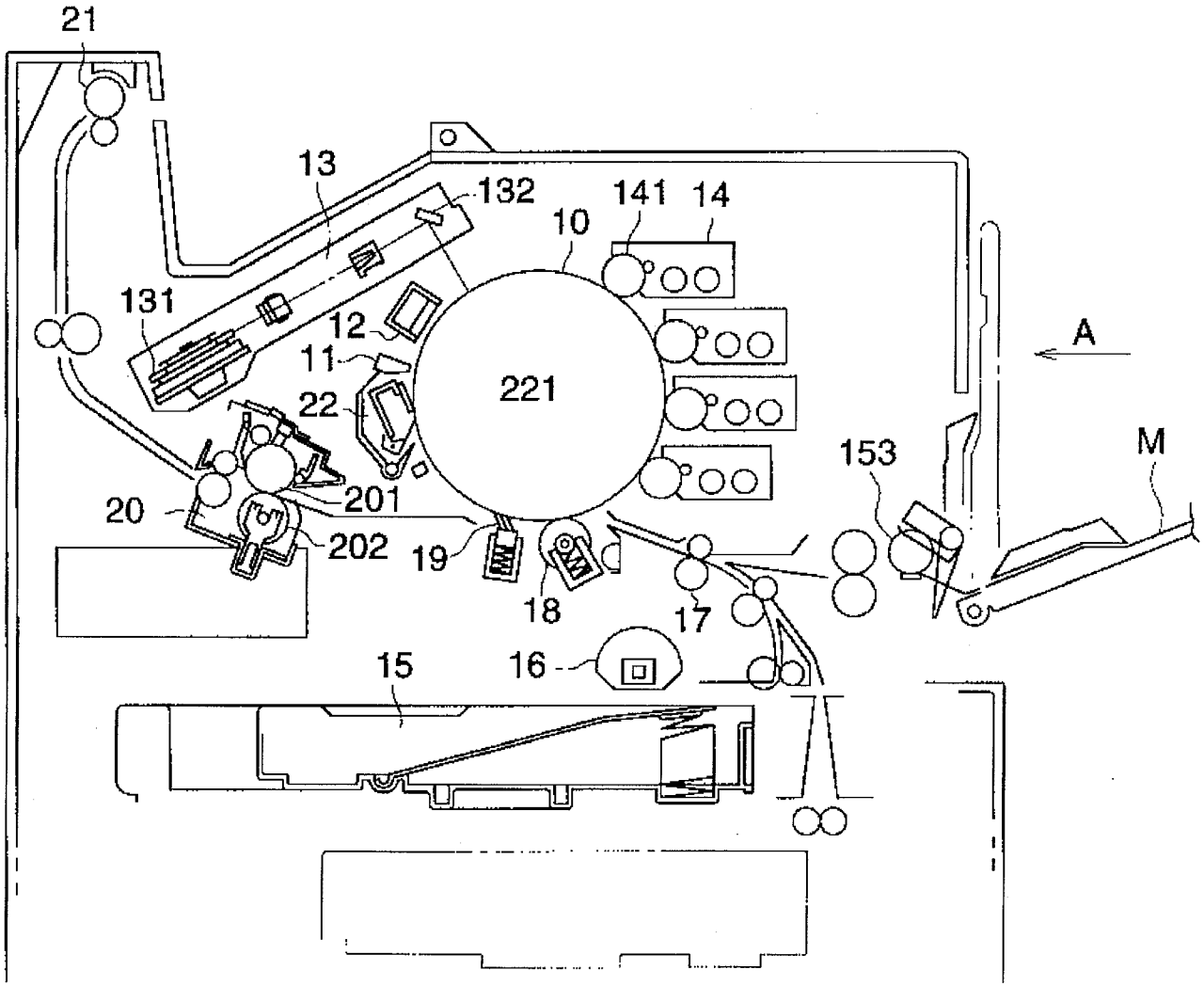
FIG. 1 is a view showing a sectional structure of a color image forming apparatus of the present invention.

In FIG. 1, numeral 10 is a photoreceptor drum, which is an image forming body, and which is formed by coating an OPC photoreceptor onto the drum. The photoreceptor drum is electrically grounded and rotated clockwise. Numeral 12 is a scorotron charger which uniformly charges the peripheral surface of the photoreceptor drum 10 with a charging voltage $V_H$ by a corona discharge conducted between a grid, the potential voltage of which is kept to $V_G$, and a corona discharge wire. Before the charge by the scorotron charger 12, exposure by a PCL11 using a light emitting diode, or the like, is carried out so that the peripheral surface of the photoreceptor is discharged in order to erase history of the photoreceptor's previous image formation.

After the photoreceptor has been uniformly charged, image exposure is carried out by an image exposure means 13 according to an image signal. The image exposure means 13 is composed as follows. A laser diode, not illustrated in the drawing, is used as a light emitting source. Emitted light passes through a rotating polygonal mirror 131, an fθ lens, and the like, the optical path is bent by a reflection mirror 132, and scanning is conducted. Then, a latent image is formed by the rotation of the photoreceptor drum 10 (subsidiary scanning). In this example, exposure is conducted on character portions, and a reversal latent image is formed in which the potential voltage of the character portions is equal to the low potential voltage of $V_L$.

A total of 4 developing units 14, in which developers composed of yellow (Y), magenta (M), cyan (C), and black (BK) toners and carriers, are respectively accommodated, are provided around the photoreceptor drum 10. Initially, the first color development is carried out by a rotating developing sleeve 141, in which a magnet is housed, and which holds developer thereon. Developer is made of carriers, in which ferrite is used as a core, around which insulation resin is coated, and toners, in which polyester is used as main material, and to which pigment corresponding to a color, charge control agents, silica, titanium oxide, etc., are added. The thickness of the developer layer is restricted to 100 through 600μ on the developing sleeve 141 by a layer forming means and is conveyed to a developing area.

The size of a gap between the developing sleeve 141 and the photoreceptor drum 10 in the developing area is formed to be 0.2 through 1.0 mm which is larger than the developer layer thickness. An AC bias voltage of $V_{AC}$ and a DC bias voltage of $V_{DC}$ are superimposed and impressed upon the gap. The polarity of $V_{DC}$ and $V_H$ is the same as that of the charged toner. Accordingly, the toner, whose release from carrier is triggered by $V_{AC}$, does not adhere to the $V_H$ portion, the potential voltage of which is higher than $V_{DC}$, but adheres to the $V_L$ portion, the potential voltage of which is lower than $V_{DC}$, and the latent image is visualized (reversal development).

After the first color has been visualized, the sequence enters the second color formation process. Uniform charging is carried out again by the scorotron charger 12, and the latent image according to the second color image data is formed by the image exposure means 13. At this time, the discharge which was carried out by the PCL11 in the first color image formation process is not carried out because toner which has adhered to the first color image portion is scattered when the potential voltage around the image portion is suddenly lowered.

In the photoreceptor having potential voltage of $V_H$ over the entire surface of the photoreceptor drum 10, the same latent image as that of the first color is formed, on a portion on which the first color image has not been formed, and developed. However, the portion, on which the first color image has been formed, is developed again as follows. A latent image, the potential voltage of which is $V_M$, is formed on the above-described portion by light-shading of the toner, which has adhered to the first image portion, and by electric charges of the toner itself. Then, the latent image is developed corresponding to the potential voltage difference between $V_{DC}$ and $V_M$. On the portion on which the first color image and the second color image are superimposed, when the first color latent image, the potential voltage of which is $V_L$, is developed, the color balance between the first color and the second color is lost. Accordingly, sometimes, the exposure amount of the first color is decreased, and the potential voltage of the first color latent image is made to have an intermediate potential voltage as follows: $V_H > V_M > V_L$.

The third color and the fourth color latent images are processed by the same image formation process as that of the second color latent image. Four color visual images are then formed on the surface of the photoreceptor drum 10.

On the other hand, a recording sheet P which is conveyed from a sheet feed cassette 15 through a semi-circular roller 16, is temporarily stopped, and fed to a transfer area by the rotation of a sheet feed roller 17 in timed relationship with the transfer process.

In the transfer area, a transfer roller 18 is in pressure-contact with the peripheral surface of the photoreceptor drum 10 in timed relationship with the transfer operation. The recording sheet P fed from the sheet feed cassette, is sandwiched between the photoreceptor drum 10 and the transfer roller 18, and multi-color images are collectively transferred onto the sheet P.

Next, the recording sheet P is discharged by a separation brush 19 which has come into pressure-contact with the photoreceptor drum 10 almost simultaneously with the transfer roller. The recording sheet P is separated from the peripheral surface of the photoreceptor drum 10, and conveyed to a fixing unit 20. Toner is heat-fused by a thermal roller 201 and by contact-pressure of a pressure roller 202, and the recording sheet P is then conveyed outside the apparatus through a sheet discharge roller 21. The transfer roller 18 and the separation brush 19 are withdrawn from the peripheral surface of the photoreceptor drum 10 after the recording sheet P has passed, and are prepared for the next toner image formation.

On the other hand, residual toner on the photoreceptor drum 10, from which the recording sheet P has been separated, is removed and cleaned when a blade 221 of a cleaning unit 22 comes into pressure-contact with the photoreceptor drum 10. The surface of the photoreceptor drum 10 is discharged again by the PCL11 and re-charged by the charger 12, and the photoreceptor drum 10 enters the next image formation process. In this connection, the blade 221 is withdrawn from the peripheral surface of the photoreceptor drum 10 immediately after the cleaning of the surface of the photoreceptor drum 10.

The features of functions and the performance of developing units of the above-described apparatus will be explained below.

Figure 2:
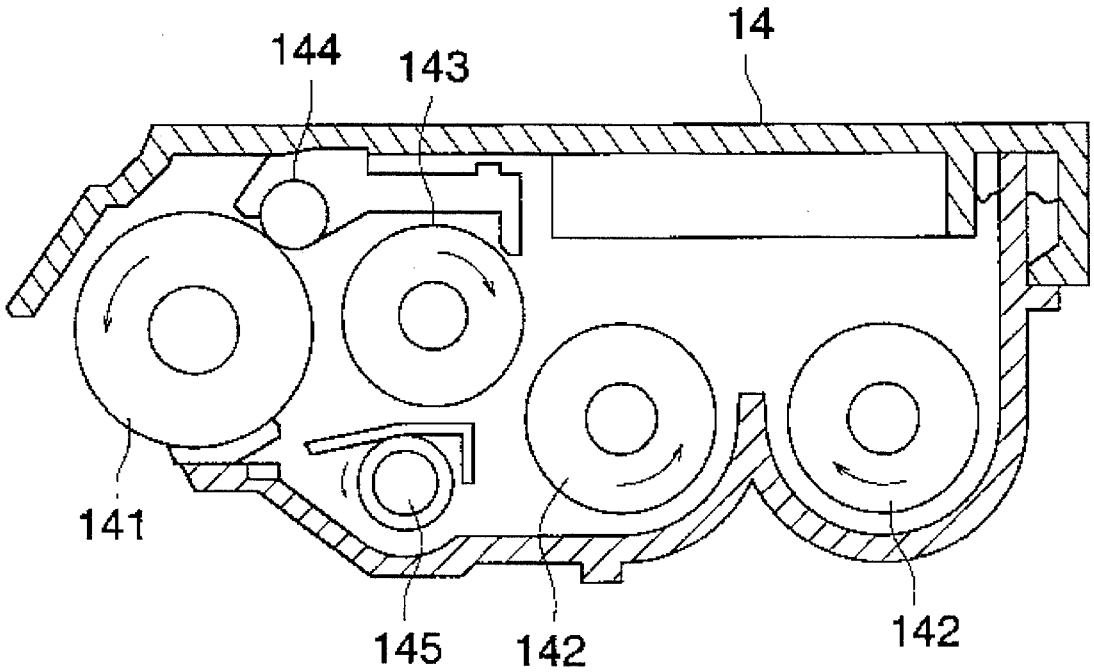
FIG. 2 is a view showing a sectional structure of a developing unit.

FIG. 2 shows the structure of the developing unit 14. In FIG. 2, toner supplied from a toner box, which is not shown in the drawing, drops into the right end portion of the developing unit, and is stirred and mixed with carriers by a pair of stirring screws 142 which are respectively rotated in a direction opposite to each other. Then, due to the foregoing, the toner is charged in a predetermined charging amount (Q/M).

The stirred two-component developer is conveyed to a developing sleeve 141 through a feed roller 143, and formed into a thin layer by a layer thickness regulation member 144. The developer is conveyed to the developing area of the photoreceptor drum 10, and an electrostatic latent image is reversal-developed according to the following conditions.

Developing gap: 0.5 mm

Developer conveyance amount: 20 through 30 mg/cm$^2$

Developing bias voltage
(AC): 2 KV, 8 KHz
(DC): −650 V

Rotational direction of the developing sleeve: normal rotation with respect to that of the photoreceptor drum Developing condition control: control of the number of rotations of the developing sleeve or developing bias voltage control (a patch image is formed on the photoreceptor by laser beams and developed. After the development, the reflection density is measured and the image density is adjusted.)

Figure 3:
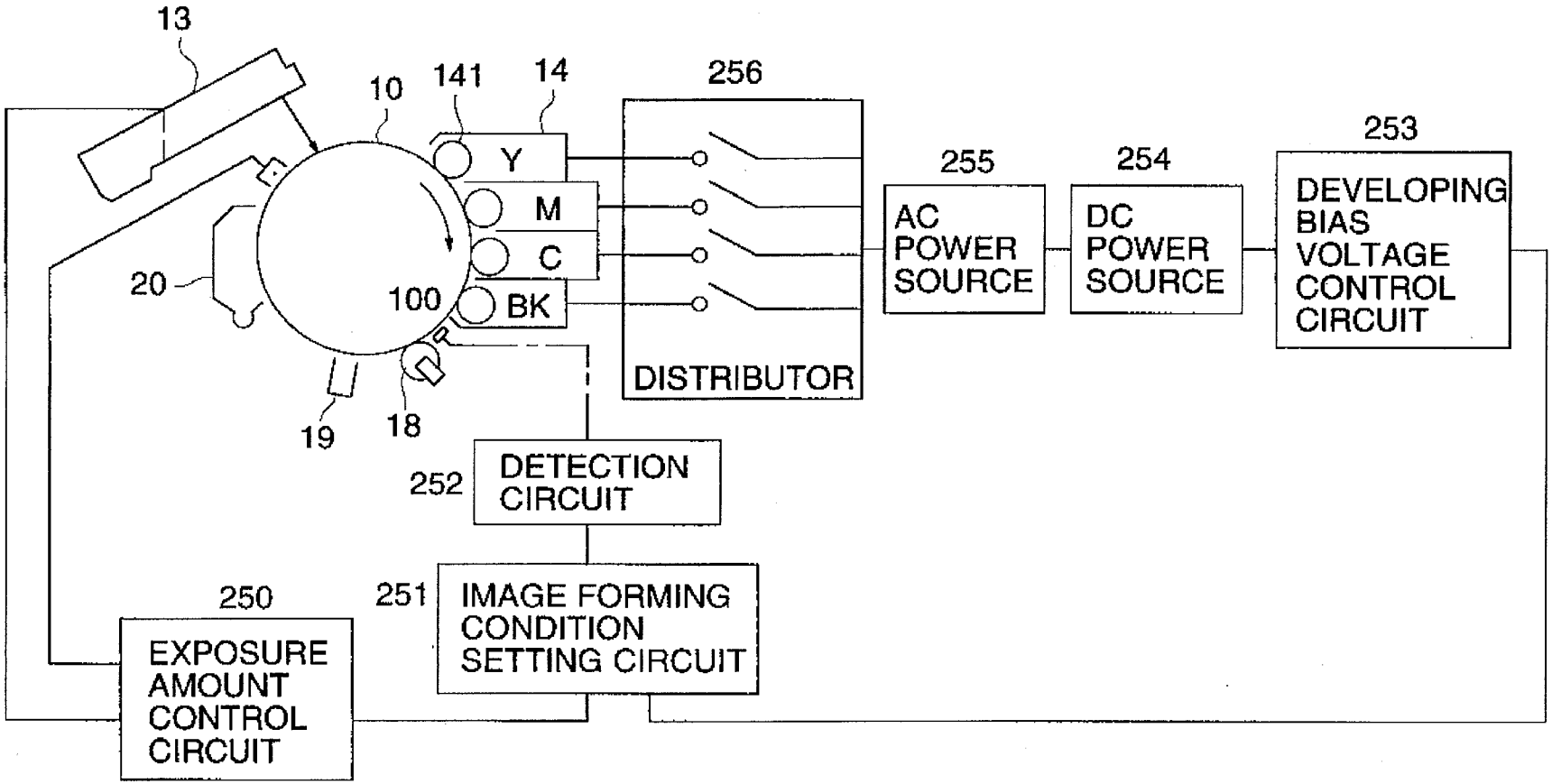
FIG. 3 is a view explaining an impression method of a developing bias voltage.

The Developing bias voltage is impressed on the developing unit as follows. As shown in FIG. 3, a DC power source 254 and an AC power source 255, which are provided in the machine main body, are controlled by a developing bias voltage control circuit 253, and a bias voltage is impressed upon only the developing unit selected by a distributor 256. In this case, the density of the reference patch image, which is controlled by an exposure amount control circuit 250 and is formed on the photoreceptor drum 10 by the image exposure means 13, is detected by a sensor. Further, an analog signal indicating the density detected by a detection circuit 252 is A/D converted into a digital density signal. Then, DC voltage and AC voltage, which are actually impressed upon the developing unit, are set by an image formation condition setting circuit 251 based on the above-described digital signal.

Next, referring to FIGS. 4, 5 and 6, the structure of a rotation drive system for the developing unit will be described.

Figure 4:
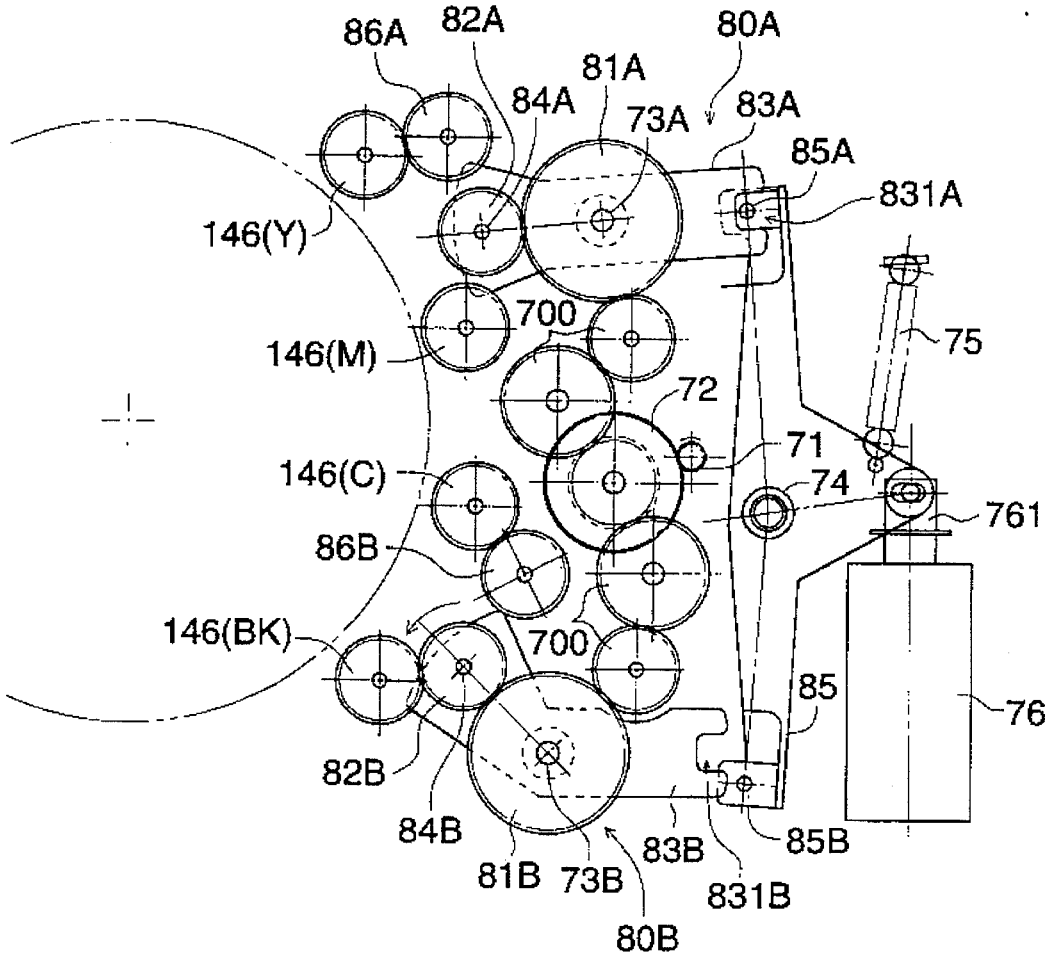
FIG. 4 is a front view of a developing unit driving section.
Figure 5:
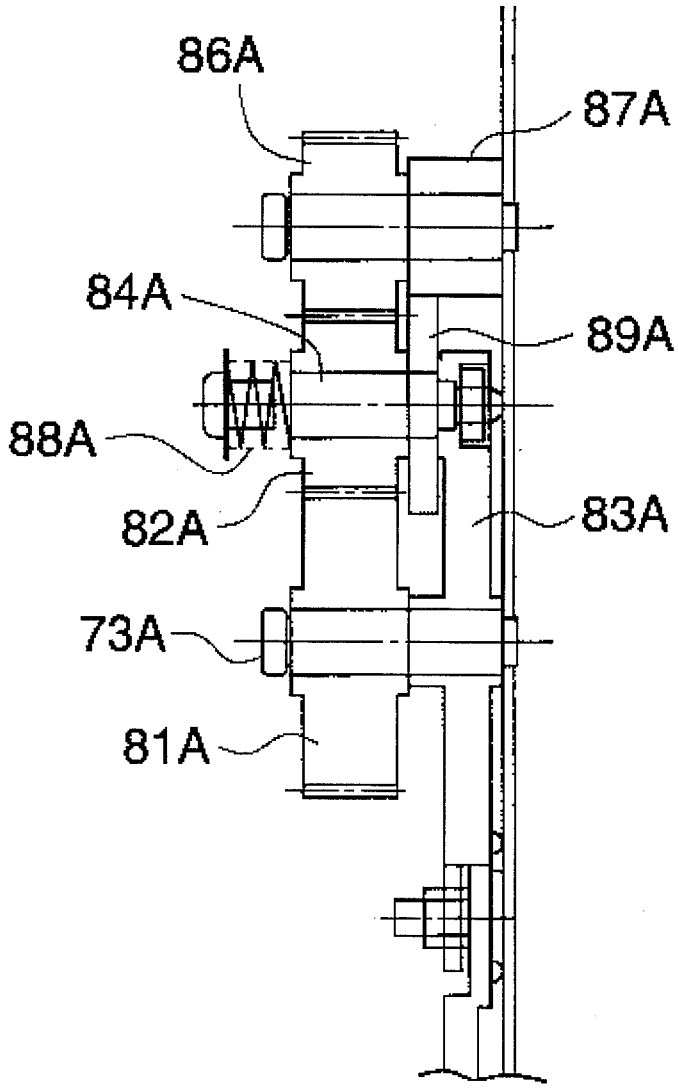
FIG. 5 is a sectional view of a planetary gear mechanism.

FIG. 4 is a front view of the developing unit driving section. FIG. 5 is a sectional view of a planetary gear mechanism 80A, which will be described later. FIG. 6 is a plan view of a portion relating to the drive mechanism of the developing unit.

A double gear 72 is provided so that it can be engaged with a pinion gear of a developing unit driving motor 71. The rotation by the developing unit driving motor 71 is transmitted to sun gears 81A and 81B of planetary gear mechanisms 80A and 80B through this double gear 72 and a gear train 700. The planetary gear mechanism 80A is composed of the sun gear 81A, the planetary gear 82A, a planetary arm 83A, a planetary gear shaft 84A, a compression spring 88A, a roller, and a sun gear shaft 73A. The sun gear 81A is always engaged with the planetary gear 82A. The planetary arm 83A is rotatably supported by the planetary gear shaft 84A, and also supports the planetary gear shaft 84A. The compression spring 88A is attached to the planetary gear shaft 84A, and puts a light load on the planetary gear 82A when the gear is rotated. This is due to the following reason: when the sun gear 81A is rotated, the planetary gear 82A is positively revolved.

Figure 6:
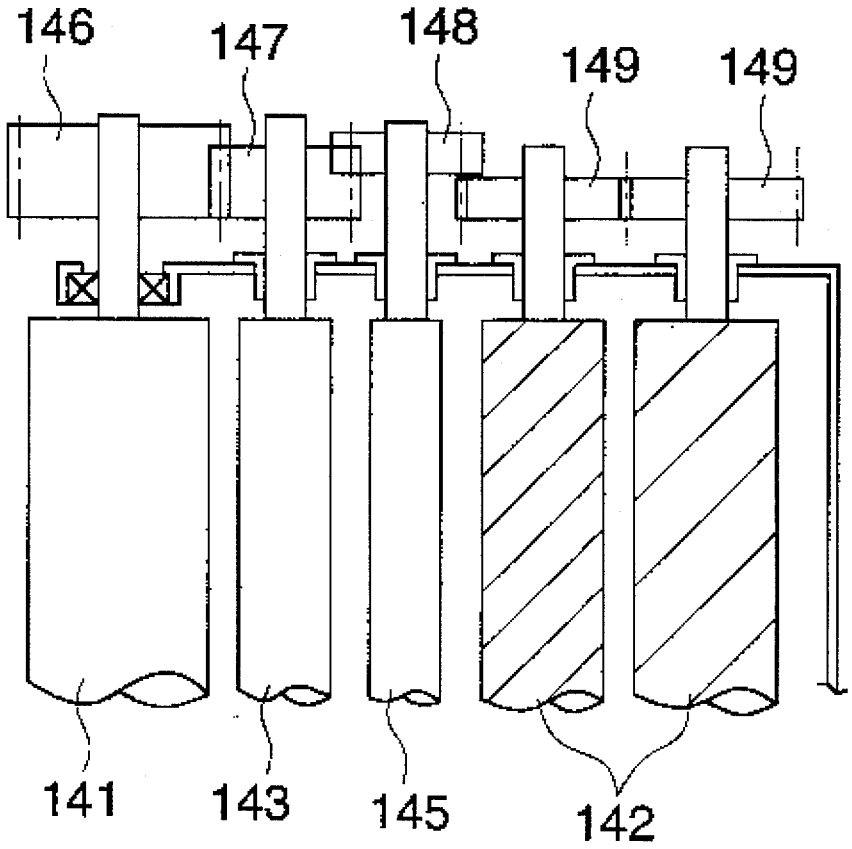
FIG. 6 is a plan view showing a portion relating to the drive mechanism of the developing unit.

A developing gear 146 is attached to the developing sleeve 141 of each developing unit as shown in FIG. 6. That is, in the image forming apparatus of this example, 4 developing gears 146(Y), 146(M), 146(C), and 146(BK) are provided. In this connection, the developing gear 146 is engaged with a collection roller gear 147, and further engaged with a supply roller gear 148 and 2 stirring screw gears 149 in the developing unit.

An idler gear 86A which is engaged with the developing gear 146(Y), is disposed at an upper position of the planetary gear 82A in the direction of revolution of the planetary gear 82A. The developing gear 146(M) is disposed at a lower position of the planetary gear 82A in the direction of revolution of the planetary gear 82A. The idler gear 86A and the developing gear 146(Y) are coaxially provided, respectively, with a collision roller 87A on their shafts. When the planetary gear 82A is revolved, the roller 89A collides with the collision roller 87A, and thereby, further revolution of the planetary gear 82A is prevented and the distance between the gear shafts is kept so that gears have appropriate backlash. Further, in the planetary arm 83A, a groove portion 831A is formed at the position opposite to the planetary gear shaft 84A with respect to the sun gear shaft 73A, and a revolution prevention pin 85A of a switching member 85, which will be described later, is inserted into the groove portion 831A.

The structure of the planetary gear mechanism 80B is the same as that of the planetary gear mechanism 80A, and therefore, the explanation is omitted here. In the drawing, each part of the mechanism 80B is denoted with B corresponding to that of the mechanism 80A.

The switching member 85 can be rotated around a switching member rotation shaft 74, and forced counter-clockwise by a spring 75. The member 85 is connected to a plunger 761 of the switching solenoid 76. When the plunger 761 is pulled by the solenoid 76, the member 85 is rotated clockwise against the spring force.

Figure 7:
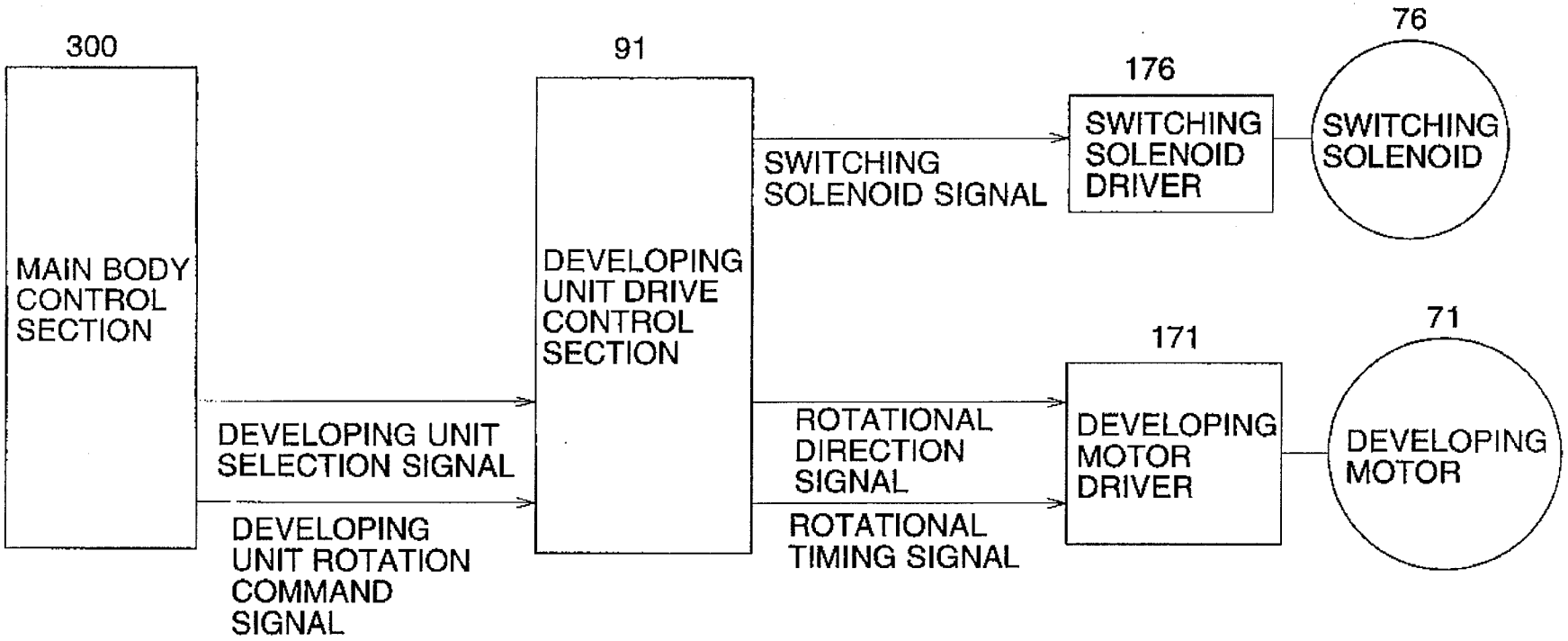
FIG. 7 is a block diagram explaining the developing unit drive control section.

As shown in FIG. 7, a developing unit drive control section 91 receives a developing unit selection signal and a developing unit rotation command signal from a main body control section 300, and controls the direction of rotation and the rotation timing of the developing unit driving motor 71 and the operation and its timing of the switching solenoid 76.

In this case, a switching solenoid signal sent from the developing unit drive control section 91 is converted into the actual driving power by a switching solenoid driver 176, and this then drives the switching solenoid 76. Further, a rotation direction signal and a rotation timing signal sent from the developing unit drive control section 91 is converted into the actual driving power by a developing motor driver, and this then drives the developing motor 71.

Figure 8:
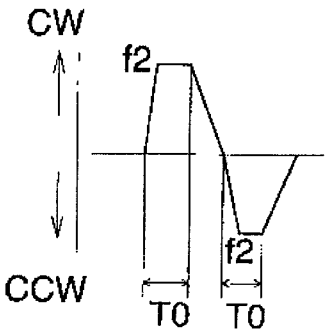
FIGS. 8(*a*) through 8(*d*) are time charts showing operations of a developing unit drive motor and a switching solenoid.
Figure 8:
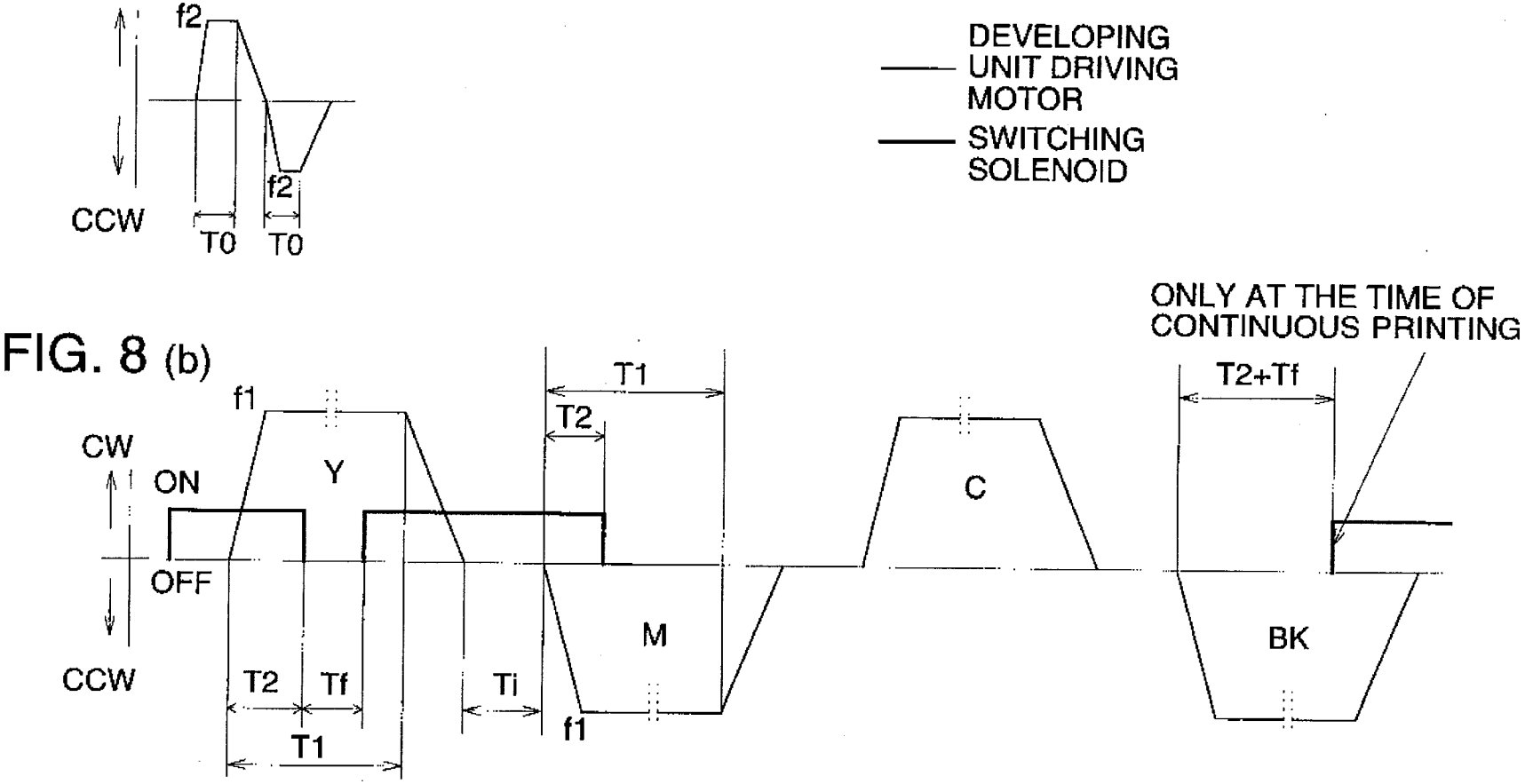
Figure 8:
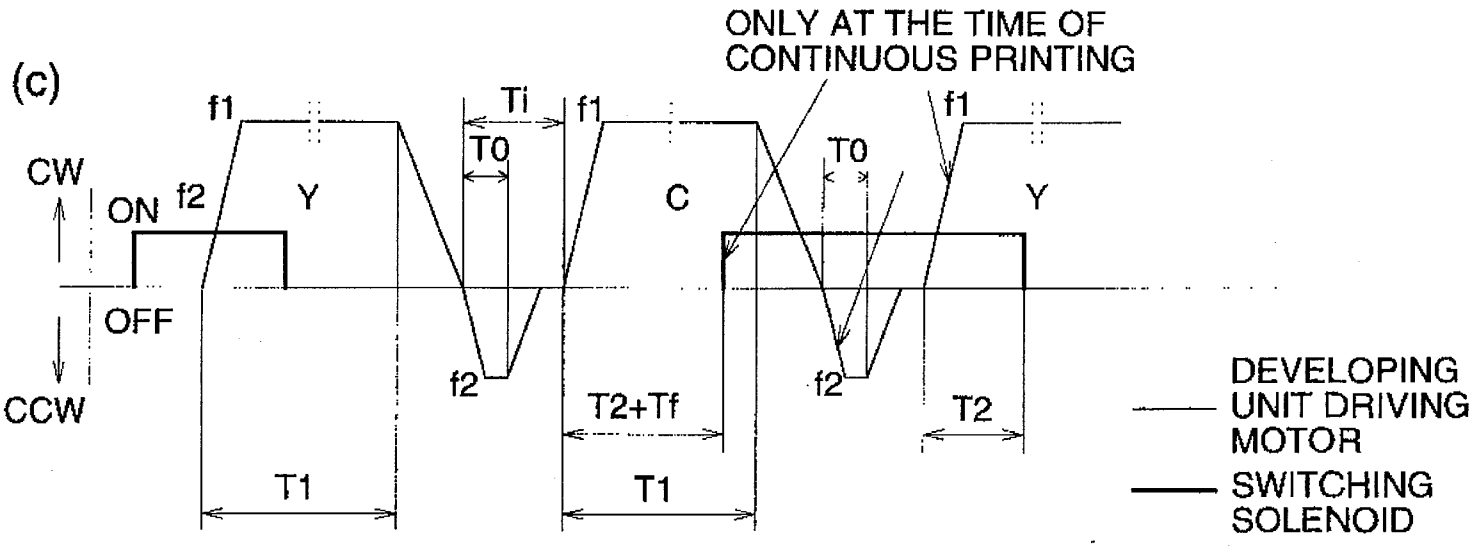
Figure 8:
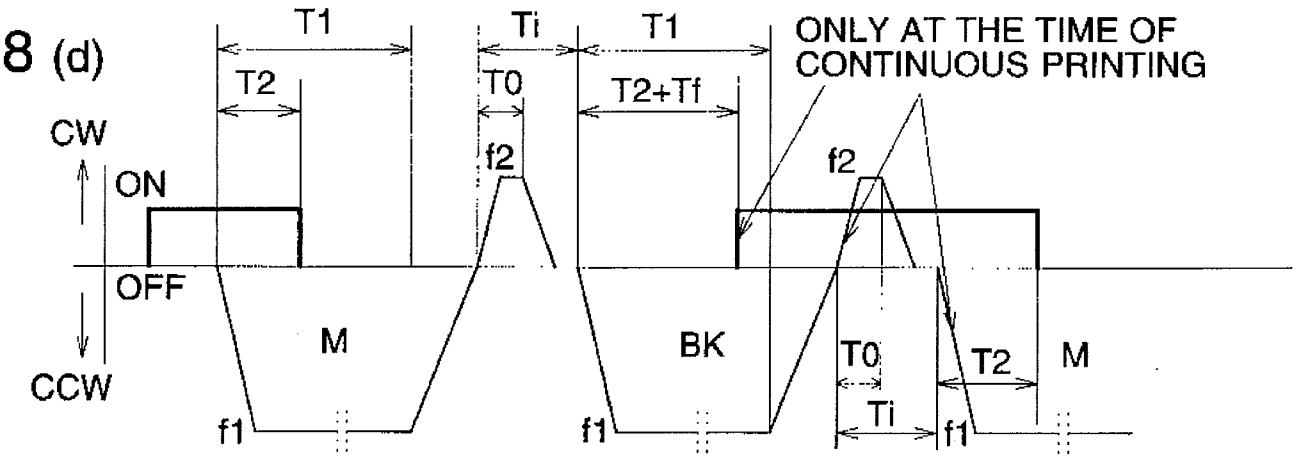
Figure 9:
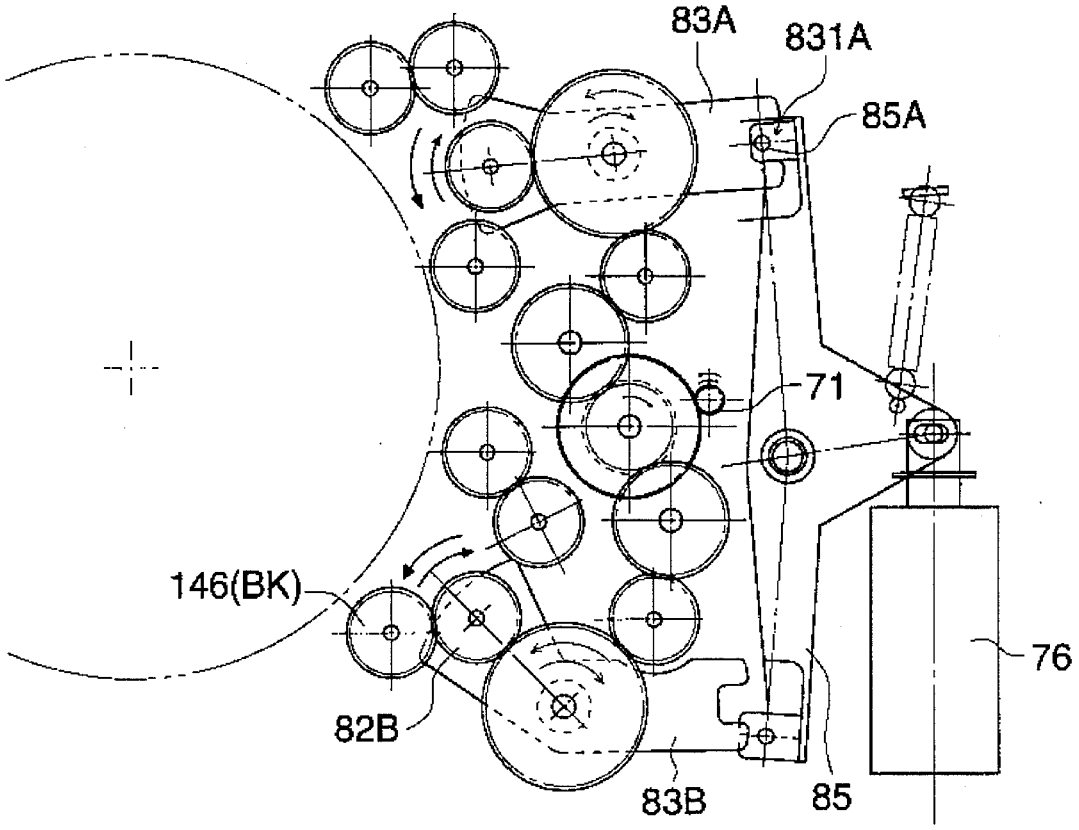
FIG. 9 is a view (1) explaining a developing unit driving operation.
Figure 10:
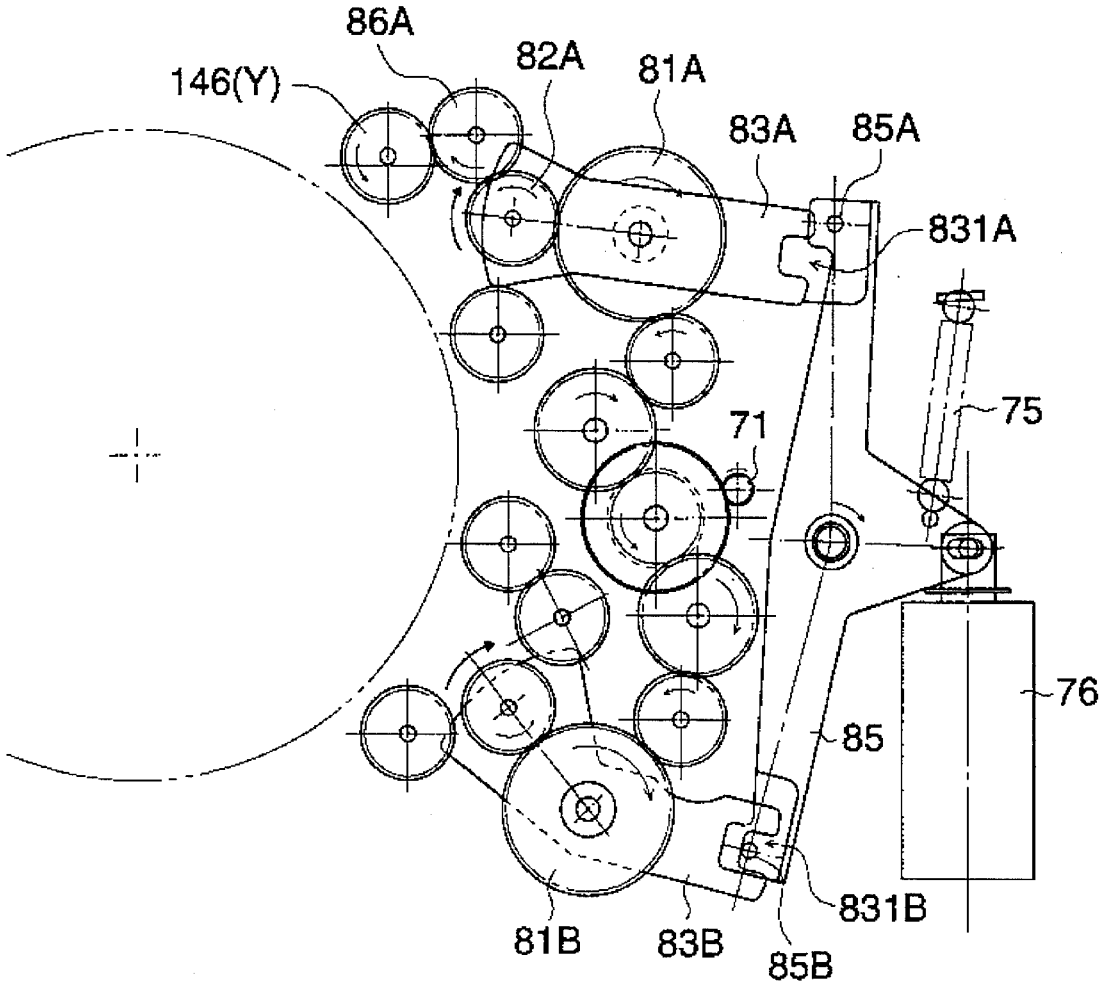
FIG. 10 is a view (2) explaining the developing unit driving operation.
Figure 11:
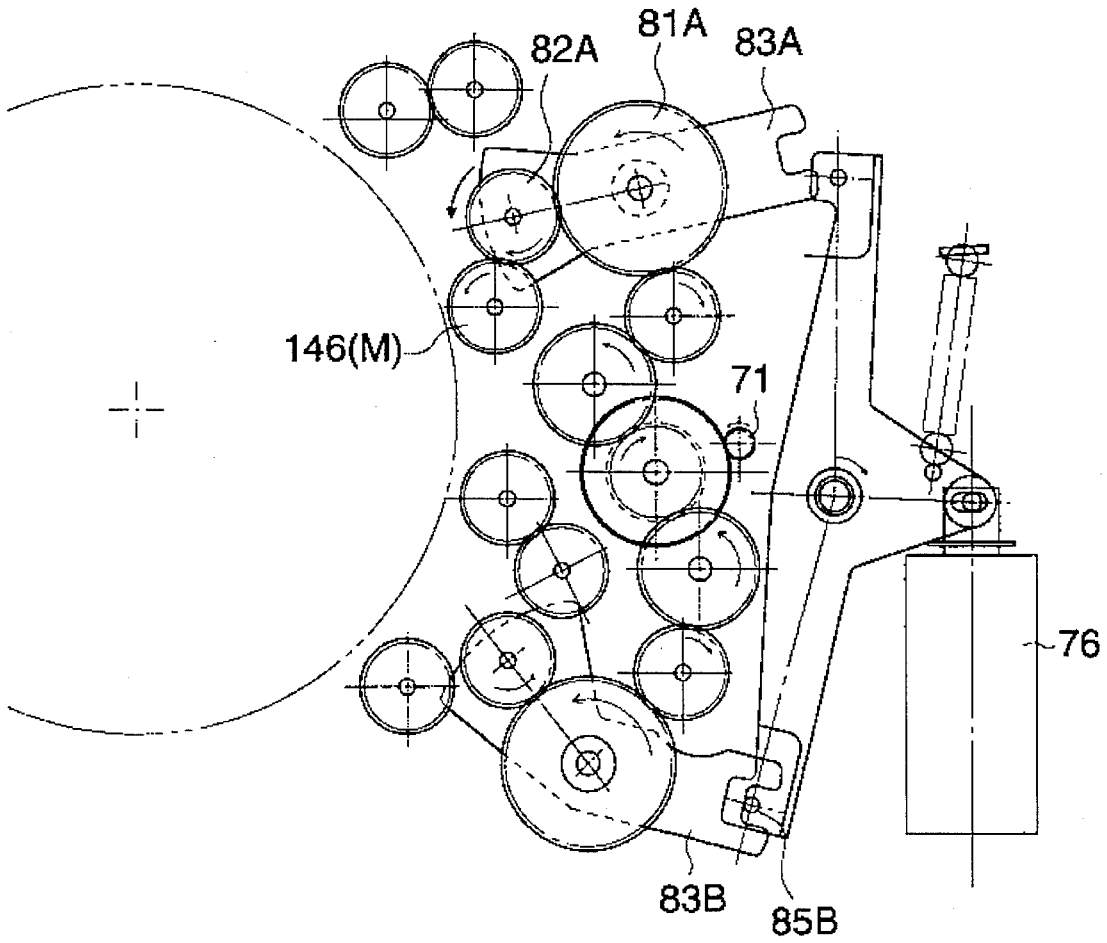
FIG. 11 is a view (3) explaining the developing unit driving operation.
Figure 12:
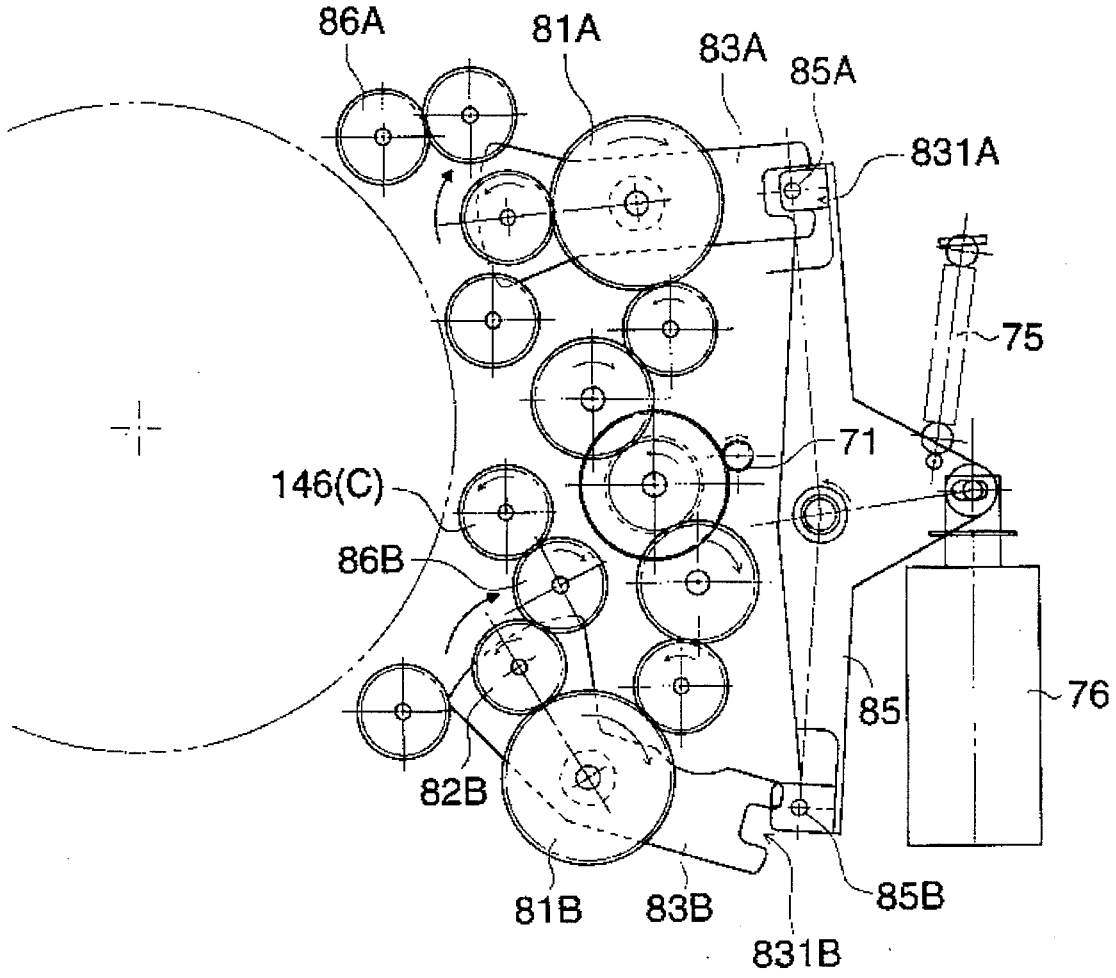
FIG. 12 is a view (4) explaining the developing unit driving operation.
Figure 13:
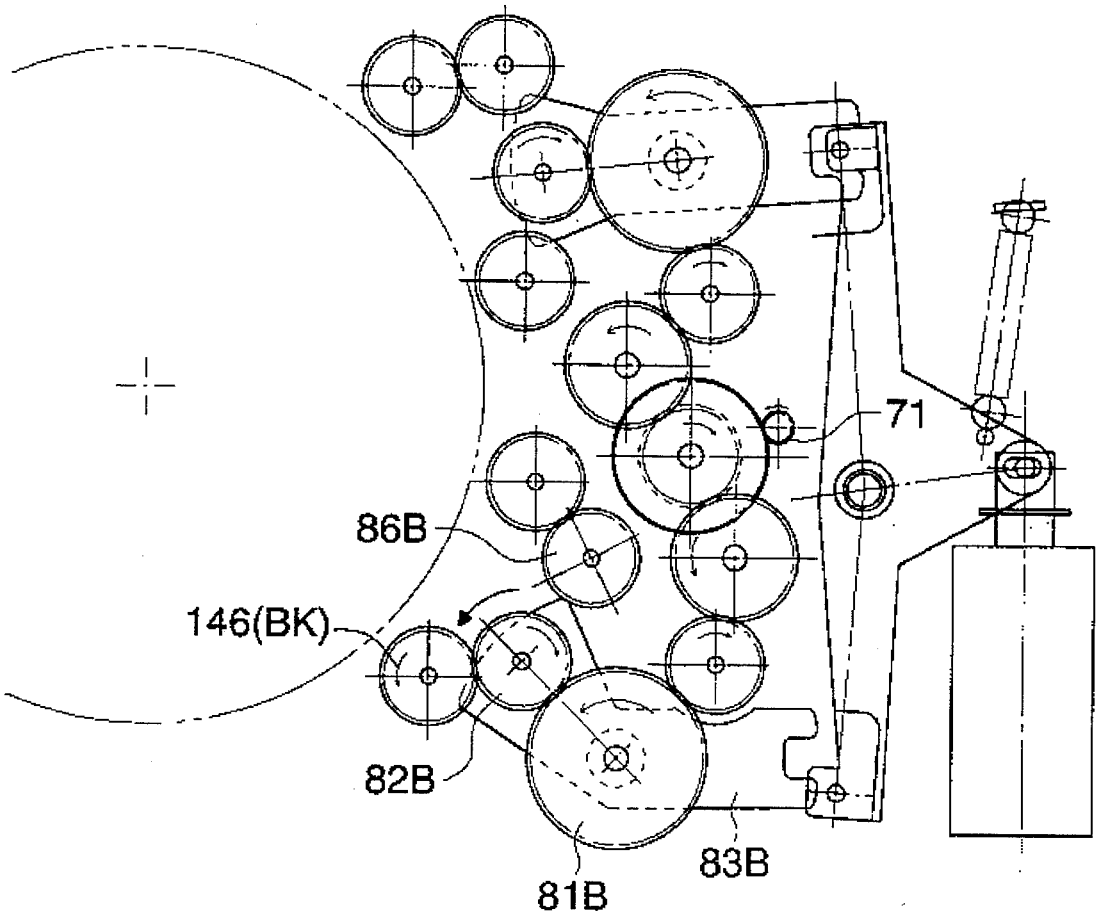
FIG. 13 is a view (5) explaining the developing unit driving operation.

Next, referring to FIGS. 4 through 13, operations of the developing unit driving section will be described below. FIG. 8 shows a time chart of operations of the developing unit driving motor 71 and the switching solenoid 76. In the drawing, f1=1150 rpm, f2=350 rpm, $T_0$=100 msec., $T_1$=4 sec., $T_2$=500 msec., $T_S$=500 msec., $T_f$=3 sec., $T_t$=500 msec. A solid thin line shows rotational motions of the motor. A solid thick line shows motions of the solenoid.

At the time of preparation for image formation, for example, a power supply of the apparatus is turned on, the developing unit drive control section 91 controls the switching solenoid 76 and developing unit driving motor 71 as follows. The switching solenoid 76 is not operated, and the developing unit driving motor 71 rotates normally and is reversed by a slight rotation amount with low speed ($f_2$), and then stops. Due to this operation, the rotation force is respectively applied to the planetary arm 83A and 83B in the normal direction and reversal direction. In spite of the position of the planetary arm 83A and 83B, and and the switching member 85, since the switching member 85 is forced counter-clockwise, the revolution prevention pin 85A enters the groove portion 831A of the planetary arm 83A. The rotation of the planetary arm 83A is prevented and the rotation of the planetary arm 83B is allowed. Further, the planetary gear 82B is engaged with developing gear 146 (BK). The above-described condition is an initial condition. (conditions in FIG. 8(*a*) and FIG. 9)

In this connection, the planetary gear 82B is engaged with the developing gear 146 (BK) in the initial condition for the reason why monochrome image formation in black is most frequently carried out even in the color image forming apparatus.

Next, when the timing of rotation of the developing unit corresponds to the operation of the apparatus, the developing unit selection signal and the developing unit rotation command signal are inputted from the main body control section into the developing unit drive control section 91.

For example, the developing unit drive control in the case where image formation is carried out using 4 color toners of (Y), (M), (C), and (BK) is considered now, as follows. (Refer to FIG. 8(*b*).)

Initially, when commands of the selection of the developing unit (Y) (the uppermost developing unit in the drawing), and rotation start of the developing unit are given, the developing unit drive control section 91 conducts the attraction operation of the switching solenoid 76, and shortly after that, rotates the developing unit driving motor 71 clockwise. Due to the above operations, the planetary arm 83B is rotated clockwise by the rotational force of the sun gear 81B. When the groove portion 831B comes to a portion into which the revolution prevention pin 85B of the switching member 85 enters, the switching member 85 is rotated by the attraction force of the switching solenoid 76, and the revolution prevention pin 85B enters the groove portion 831B, so that the rotation of the planetary arm 83B is prevented at that position. When the revolution prevention pin 85B enters the groove portion 85B, the revolution prevention pin 85A is detached from the groove portion 831A of the planetary arm 83A, and the planetary arm 83A is rotated clockwise by the rotational force of the sun gear 81A. When the planetary gear 82A is revolved to the position at which the gear 82A is engaged with the idler gear 86A, the planetary arm 83A and planetary gear 82A can not be further revolved. The rotational force of the sun gear 81A is transmitted to the planetary gear 82A for rotation, and the developing gear 146(Y) is rotated counter-clockwise through the idler gear 86A. (conditions in FIG. 10) Then said driving motor rotates with a predetermined speed ($f_1$).

The attraction operation of the switching solenoid 76 is released after the planetary arm 83A has been rotated. The switching member 85 is forced counter-clockwise by a spring 75, and the revolution prevention pin 85A touches a portion at which no groove portion is provided, so that further rotation of the switching member 85 is prevented, and accordingly, there is no problem.

Next, a command of stopping of the rotation of the developing unit is given, and then the developing unit driving motor 71 stops. When a command of the rotation start of the developing unit (M) (in the drawing, the second developing unit from above) is given, the developing unit drive control section 91 activates the switching solenoid 76, and after a short time delay, rotates the developing unit driving motor 71 counter-clockwise. Due to the above operations, the planetary arm 83A is rotated counter-clockwise by the rotation force of the sun gear 81A, and the planetary gear 82A is disengaged from the idler gear 86A. The planetary gear 82A revolves counter-clockwise to a position at which the gear 82A is engaged with the developing gear 146 (M), and after the engagement, the planetary gear 82A is rotated. That is, the developing gear 146 (M) is rotated counter-clockwise.

At that time, the rotation of the planetary arm 83B is prevented by the revolution prevention pin 85B of the switching member. That is, the planetary gear 82B is only idly rotated. (conditions in FIG. 11)

The attraction operation of the switching solenoid 76 is released, as described above, after the planetary arm 83A has been rotated.

Next, when a command of stopping of the rotation of the developing unit is given, the developing unit driving motor 71 is stopped. When a command of start of rotation of the developing unit (C), (in the drawing, the third developing unit from above), is given, the developing unit drive control section 91 only rotates the developing unit driving motor 71 clockwise. Due to this operation, the planetary arm 83A is rotated clockwise by the rotational force of the sun gear 81A. When the groove portion 831A comes to a portion at which the revolution prevention pin 85A of the switching member 85 enters, the switching member 85 is rotated by the pulling force of the spring 75, and the revolution prevention pin 85A enters the groove portion 831A. The rotation of the planetary arm 83A is prevented at that position, and the planetary gear 82A is idly rotated. When the revolution prevention pin 85A enters the groove portion 831A, the revolution prevention pin 85B is disengaged from the groove portion 831B of the planetary arm 83B, and the planetary arm 83B is rotated clockwise by the rotational force of the sun gear 81B. Then, when the planetary gear 82B is revolved to a position at which the gear 82B is engaged with the idler gear 86B, the planetary arm 83B and the planetary gear 82B can not be revolved further, the rotation force of the sun gear 81B is transmitted to the planetary gear 82B for rotation, and further, rotates the developing gear 146 (C) counter-clockwise through the idler gear 86B. (conditions in FIG. 12)

Next, a command of stopping of the rotation of the developing unit is given and driving unit driving motor 71 is stopped. When a command of start of the rotation of the developing unit (BK) (in the drawing, the lowermost developing unit) is given, the developing unit drive control section 91 rotates the developing unit driving motor 71 counter-clockwise. Due to the above operations, the planetary arm 83B is rotated counter-clockwise by the rotation force of the sun gear 81B, and the planetary gear 82B is disengaged from the idler gear 86B. Then, the planetary gear 82B is revolved counter-clockwise to a position at which the gear 82B is engaged with the developing gear 146 (BK), and after the engagement, the planetary gear 82B is rotated. That is, the developing gear 146 (BK) is rotated counter-clockwise. (Said driving motor rotates with said predetermined speed ($f_1$)).

At that time, since the rotation of the planetary arm 83A is prevented by the revolution prevention pin 85A of the switching member, the planetary arm 83A is not rotated. That is, the planetary gear 82A is only idly rotated. (conditions in FIG. 13)

Finally, a command of stopping of the rotation of the developing unit is given, and the developing unit drive motor 71 stops. Then, the system prepares for the next image formation.

Next, the developing unit drive control, in the case where image formation is carried out using, for example, 2 color toners of (Y) and (C), will be described. (Refer to FIG. 8(*c*))

In this case, the basic operations are the same as those described above. However, after the developing unit (Y) has been rotated, the developing unit (C) can not be rotated by using only the method in which the developing unit driving motor 71 is rotated clockwise in its present condition, when the rotation of the developing unit (C) is started. When the rotation of the developing unit (Y) has been completed, the planetary gear 82A is engaged with the idler gear 86A. Then, even when the developing unit driving motor 71 is rotated clockwise in its present condition, the planetary arm 83A is not rotated, and only the planetary gear 82A is rotated. Accordingly, the developing unit (Y) is rotated, (conditions in FIG. 10). Therefore, in this example, the following operations are carried out. Before the rotation of the developing unit (C) is started after the rotation of the developing unit (Y) has been completed, the developing unit driving motor is temporarily and slightly rotated counter-clockwise (with speed $f_2$); the planetary arm 83A is rotated counter-clockwise; the revolution prevention pin 85A enters the groove portion 831A by the counter-clockwise pulling force of the spring 75 of the switching member 85; and thereby, the rotation of the planetary arm 83A is prevented, and the rotation of the planetary arm 83B is allowed. Then, the developing unit driving motor is rotated clockwise, the planetary gear 82B is revolved, and after the planetary gear 82B has been engaged with the idler gear 86B, the planetary gear 82B is rotated. Due to the foregoing operations, image formation is carried out using 2 color toners, (Y) and (C).

The above explanation was made for the case in which image formation is carried out using 2 color toners, (Y) and (C). The developing unit drive control in the case where the rotational direction of the developing unit driving motor is not reversed, for example, the developing unit drive control in the case of toners of (M) and (BK), such as in the case of image formation using 2 color toners, (M) and (BK), or 3 color toners, (Y), (M) and (BK), is also carried out in the same way. (Refer to FIG. 8(*d*).)

This system is structured and controlled as described above. Accordingly, it is not necessary that the developing unit holder is rotated and moved, or an expensive electromagnetic clutch be used. According to the present invention, one of the four developing units is selected, and can be rotated when the normal and reversed rotation of the developing unit driving motor and ON/OFF operations of the solenoid are combined with each other. Accordingly, a low cost developing unit driving means in an image forming apparatus, being extremely small size, can be provided.

In this example, the order of rotation of the developing units 14 (the order of development) is determined from the upstream side in the direction of rotation of the photoreceptor drum 10 for the following reasons.

When clutches, such as an electromagnetic clutches, are used, the clutch mechanism, for transmitting the driving force, can be connected or disconnected in a short period of time.

Figure 14:
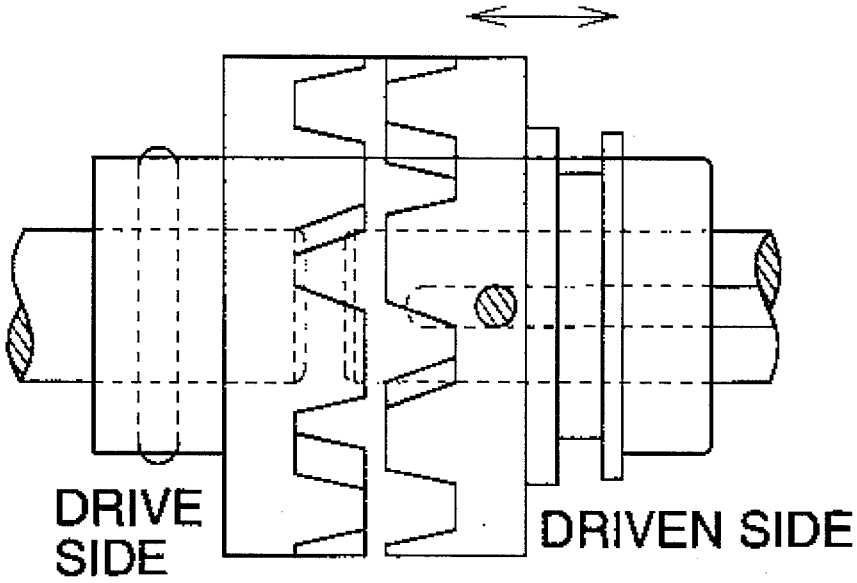
FIG. 14 is a view showing another example of a mechanical clutch.

However, when a mechanical type of clutches, as in the present invention, are used, it is preferable to control the clutches to be connected or disconnected by spending a sufficient longer period of time. The mechanical clutches are such that the engagements of gears are switched, or the connection and the disconnection between the projecting portion and the dent portion switches the transmission of the driving force as shown in FIG. 14. In the case where these mechanical clutches are used, when they are connected at high rotational speed and if claws or teeth are only slightly engaged with each other in the engagement process, sometimes, claw-skipping or tooth-skipping phenomena occur, resulting in severe vibration and noise. Accordingly, in the present invention, the developing unit driving system is controlled so that the developing motor is rotated at a speed ($f_2$), which is lower than the speed of development ($f_1$), when the clutch is connected or disconnected, or the developing motor is temporarily stopped and the gears are engaged while the developing motor is being accelerated after the start of the motor, that is, at the time when the rotation speed of the motor is relatively low.

Figure 15:
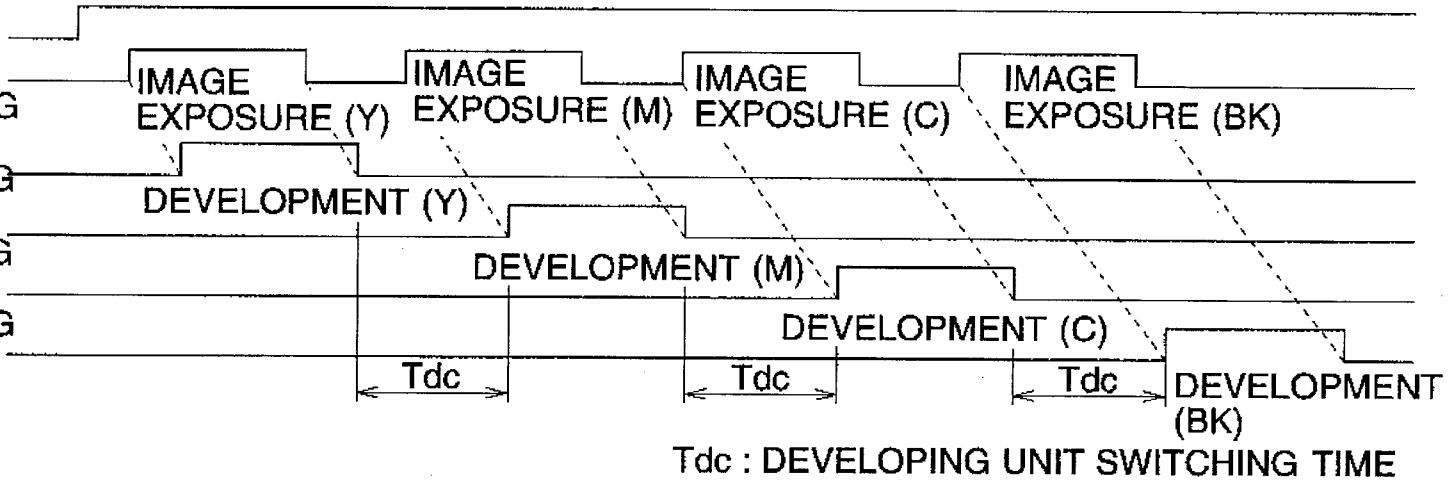
FIGS. 15(*a*) and 15(*b*) are time charts explaining the order of development.
Figure 15:
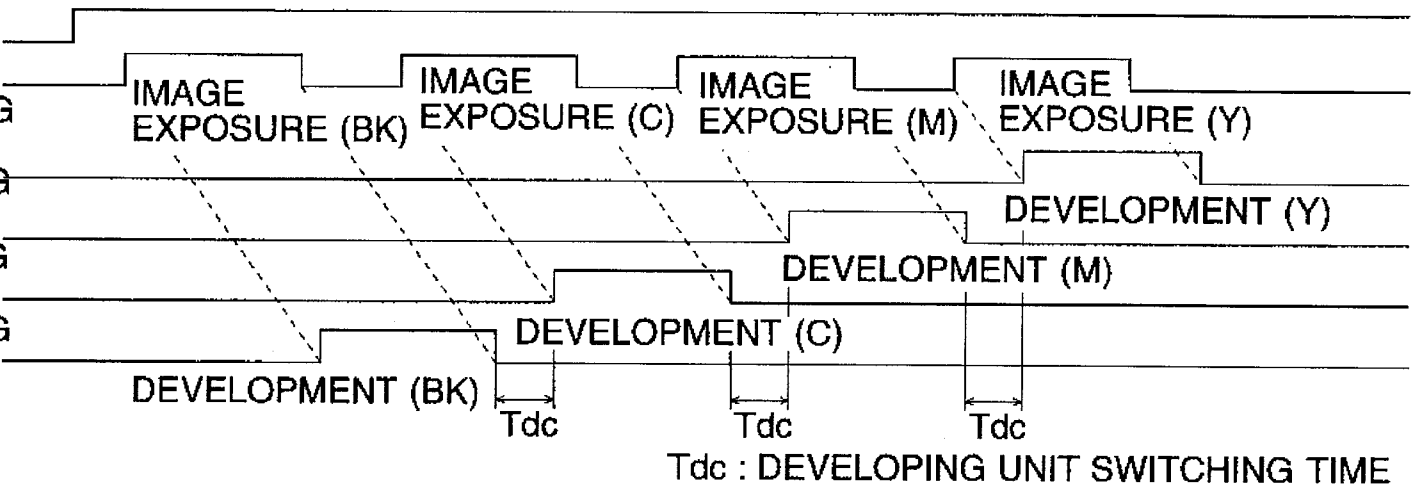

As described above, when the driving force is transmitted/interrupted in a sufficient period of time, it is advantageous that the order of rotation of the developing units (the order of development) is determined from the upstream side in the rotational direction of the photoreceptor, which will be described referring to FIG. 15 below. FIG. 15(*a*) is a time chart in the case where development is carried out using the developing units sequentially from the upstream side in the rotational direction of the photoreceptor. FIG. 15(*b*) is a time chart in the case where development is carried out using the developing units sequentially from the downstream side in the rotational direction of the photoreceptor. From the above two drawings, it can be seen that the operation switching time $T_{dc}$ of the developing units is longer in the case where the development is carried out using the developing units sequentially from the upstream side.

Due to the foregoing, when the order of development of the developing units is determined from the upstream side in the rotational direction of the photoreceptor, a developing unit driving apparatus of the present invention can be structured so that: longer developing unit switching time can be obtained; transmission/interruption of the driving force can be carried out in sufficient time utilizing the switching time in order to connect or disconnect a mechanical clutch; and vibration and noise, which may occur at the time of engagement of gears, can be greatly reduced.

In this connection, in this example, although an exclusive reversible motor is used as a developing unit driving motor, this motor can also be used as a motor for other functions. Further, the present invention can also be structured as follows. The rotational direction of the input to the developing unit driving apparatus is switched to normal or reversed when clutches, gear trains, and belts are combined in the driving force transmission route, without normally rotating the motor or reversing it.

According to the present invention, a large mechanism for rotating a developing unit holder is not necessary, and an expensive clutch, such as an electromagnetic clutch, is not necessary for transmitting/interrupting the driving force. Accordingly, an inexpensive developing unit drive means for a color image forming apparatus, being very small, can be provided.

What is claimed is:

1. A developing unit driving mechanism in use with a color image forming apparatus, comprising:

an image forming member;

an image forming means for forming a latent image on said image forming member;

a plurality of developing units, disposed around said image forming member, each for developing said latent image;

a driving motor, rotatable in a normal direction and a reverse direction which is opposite to said normal direction;

a first planetary gear mechanism, including a first sun gear and a first planetary gear, for transmitting a driving force of said driving motor to a first set of driven gears; and said first set of driven gears, connected to each of said plurality of developing units each for transmitting said driving force to each of said plurality of developing units;

wherein said first planetary gear is revolved on said first sun gear in a first direction so as to be connected with one of said first set of driven gears when said driving motor rotates in said normal direction, and said first planetary gear is revolved on said first sun gear in a second direction, being opposite to said first direction, so as to be connected with the other one of said first set of driven gears when said driving motor rotates in said reverse direction;

and said first planetary gear rotates on its axis for transmitting said driving force to a connected one of said first set of driven gears.

2. The mechanism of claim 1, wherein one of said first set of driven gears is an idler gear for reversing said driving direction of said sun gear, and for transmitting said driving force of said driving motor from said first planetary gear mechanism to one of said plurality of developing units through a further driven gear.

3. The mechanism of claim 1, further comprising:

a second planetary gear mechanism, including a second sun gear and a second planetary gear, for transmitting said driving force of said driving motor from said driving motor to a second set of driven gears;

said second set of driven gears, each for transmitting said driving force of said driving motor from said second planetary gear mechanism to one of said plurality of developing units;

wherein said second planetary gear is revolved on said second sun gear in said first direction so as to be connected with one of said second set of driven gears when said driving motor rotates in said normal direction; and said second planetary gear is revolved on said second sun gear in said second direction so as to be connected with other one of said second set of driven gears when said driving motor rotates in said reverse direction;

a planetary gear selector for preventing one of said first planetary gear and said second planetary gear from revolving, and for allowing the other one of said first planetary gear and said second planetary gear for revolving; and a developing unit drive control section for controlling the direction of said driving motor and said planetary gear selector so as to select one of said plurality of developing units to be driven by said driving motor.

4. The mechanism of claim 3, wherein said developing unit drive control section reverses a rotation direction of said driving motor when said planetary gear selector switches a selection between said first planetary gear mechanism and said second planetary gear mechanism.

5. The mechanism of claim 3, wherein said developing unit drive control section controls the direction of said driving motor and said planetary gear selector so as to select a predetermined unit of said plurality of developing units to be driven by said driving motor before said color image forming apparatus starts an image formation operation.

6. The mechanism of claim 5, wherein said predetermined unit is a black color developing unit.

7. A mechanism of claim 1, wherein said image forming member is rotatable on an axis and holds a plurality of color toner images which are developed from a plurality of color latent images;

said plurality of developing units each develops a respective one of said color latent images;

said driving motor is rotatable at high speed and at low speed and drives said plurality of developing units;

wherein the mechanism further comprises:

a plurality of mechanical clutches, each for transmitting a driving force of said driving motor to a respective one of said plurality of developing units;

wherein each of said plurality of mechanical clutches includes:

a driven member connected to said respective one of said plurality of developing units; and an engaging member, connected to said driving motor, for engaging said driven member;

wherein at least one of said driven member and said engaging member has a projecting portion, and each of said plurality of mechanical clutches is switchable between a connected state in which said driving motor is mechanically connected with said respective one of said plurality of developing units and a disconnected state in which said driving motor is mechanically disconnected from said respective one of said plurality of developing units; and a switcher for switching said each of said plurality of mechanical clutches between said connected state and said disconnected state when said driving motor is rotated at said low speed.

8. The mechanism of claim 7 wherein said plurality of developing units are respectively connected to said driving motor by said plurality of mechanical clutches in a sequence beginning from one of said plurality of developing units disposed in a most upstream side of a rotation direction of said image forming body and ending at one of said plurality of developing units disposed in a most downstream side thereof.

* * * * *